United States Patent [19]

Quiogue

[11] 4,131,867

[45] Dec. 26, 1978

[54] LAMP BALLAST ATTACHMENT DEVICE

[75] Inventor: Honesto D. Quiogue, Blacksburg, Va.

[73] Assignee: Harvey Hubbell, Incorporated, Orange, Conn.

[21] Appl. No.: 827,454

[22] Filed: Aug. 25, 1977

[51] Int. Cl.[2] ..... H01F 15/02

[52] U.S. Cl. ..... 336/65; 29/602 R; 248/23; 248/201

[58] Field of Search ..... 335/65, 67, 68; 248/201, 500, 510, 346, 19, 23, 14, 16, 302; 338/318; 29/602 R, 606

[56] References Cited

U.S. PATENT DOCUMENTS

| | | | |
|---|---|---|---|
| 2,151,799 | 3/1939 | Richter | 248/201 X |
| 2,517,510 | 8/1950 | Singer | 248/23 |
| 2,748,459 | 6/1956 | Orr | 248/23 |
| 2,796,590 | 6/1957 | Barnett | 336/65 X |
| 2,835,465 | 5/1958 | Patterson | 248/201 |
| 2,974,918 | 3/1961 | Voigtlander | 248/201 |
| 3,185,424 | 5/1965 | Sloop | 336/65 X |
| 3,287,685 | 11/1966 | Schaecher | 338/318 |
| 3,965,451 | 6/1976 | de Vos | 336/67 |

*Primary Examiner*—Thomas J. Kozma
*Attorney, Agent, or Firm*—Jerry M. Presson

[57] ABSTRACT

Disclosed is a device and method for attaching a lamp ballast to a mounting plate in a luminaire. The attachment device comprises an essentially closed eyelet at one end thereof and a straight shank at the other end thereof. The shank is insertable into a bore drilled transversely through the ballast by the ballast manufacturer for receiving conventional ballast mounting bolts. The eyelet end of the instant device receives a fastening member which is fixedly attachable to the mounting plate through mounting holes. In accordance with one aspect of this invention, pairs of such devices are mounted in opposition with their shanks inserted coaxially into opposite ends of the ballast bore to effect the attachment. The method of this invention involves forming a matrix of prelocated mounting holes for the devices to allow the attachment of different sized ballasts to the mounting plate.

21 Claims, 4 Drawing Figures

FIG. 3
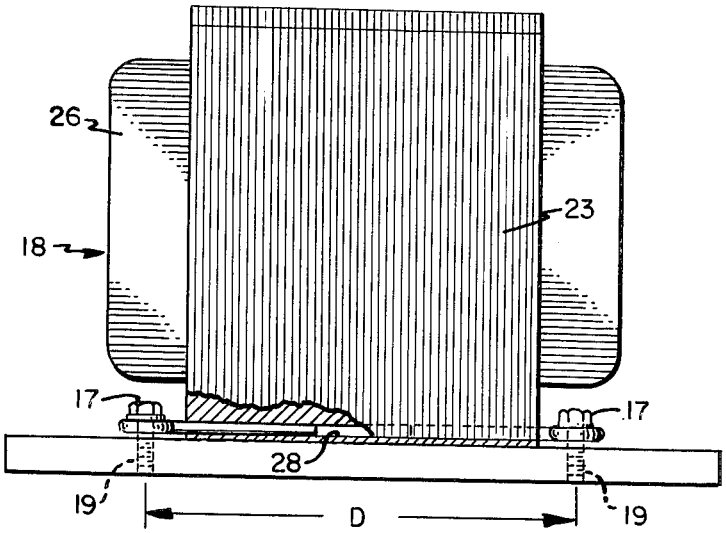
FIG. 2
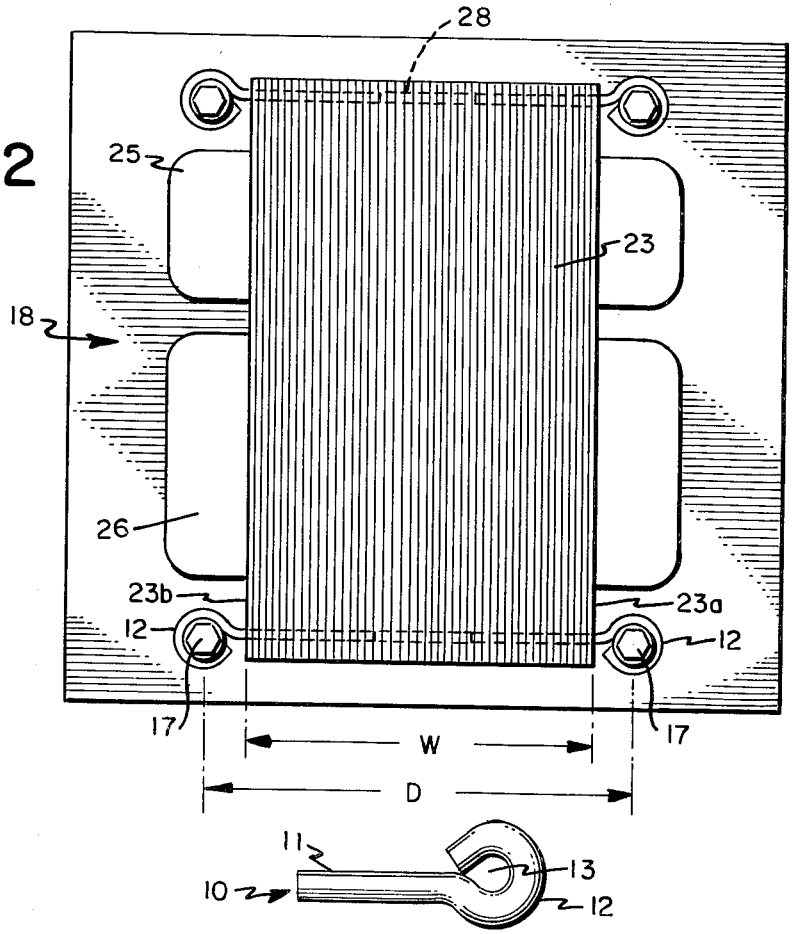
FIG. 1

LAMP BALLAST ATTACHMENT DEVICE

BACKGROUND OF THE INVENTION

This invention relates to luminaires and more particularly to devices and methods for mounting a lamp ballast on a luminaire.

Ballasts are normally utilized in luminaires of various types, such as high intensity sodium and mercury vapor lamps, as transformers, to step up the available line voltage to a level sufficient to properly energize the lamp. The ballasts are formed by a number of identical flat plates of generally rectangular shape composed of a meterial of good magnetic permeability, such as soft iron, and have primary and secondary coils of electrically conductive wire mounted therein. The plates are laminated together and provide the magnetic core for the ballast windings.

The lamp ballasts which are supplied by ballast manufacturers to lighting fixture manufacturers, who assemble and mount the ballasts and the other necessary components together in a lighting fixture, are manufactured with a plurality of holes therein, typically four or more. These holes are normally about 0.2 inch in diameter and pass through the core from one side to the other perpendicular to the plane of the laminated plates. The holes are formed by the ballast manufacturer by drilling or punching through the core plates at predetermined points adjacent the core periphery and are provided to permit the lighting fixture manufacturer to pass mounting bolts or shafts through the core. For a given ballast wattage, the length of the laminated core and hence, the transverse spacing between these bolt holes, is normally the same. However, the widths of cores having the same nominal wattage but different voltage and resistance parameters required for different types of lamps, are usually different. The ends of the mounting bolts are designed to be attached to a mounting plate by a pair of right angle mounting brackets.

The mounting brackets are elongated steel elements having two legs joined at right angles. One leg of each bracket is designed to be mounted flat against one of the core side plates and the other leg is designed to be mounted flat against an adjoining section of the mounting plate. The mounting bolts are passed through holes formed in the one leg of a first bracket concentric with the holes in the core and thence, through concentric holes formed in the one leg of a second bracket abutting an opposite side plate. The threaded ends of the bolts projecting from the bracket are captured by nuts. The other leg of each bracket is anchored to the mounting plate by screws which pass through holes formed in the other leg of each bracket and enter concentric tapped holes or apertures provided by the fixture manufacturer in underlying portions of the mounting plate.

As mentioned above, the width dimensions of ballasts supplied by various ballast manufacturers may vary for a given ballast wattage even though the length dimensions remain the same. Further, different ballast wattages normally require ballasts having both different length and width dimensions which means that the transverse spacings between and the lengths of the bolts hole will be different for each different ballast wattage. Using the aforedescribed conventional brackets, the replacement of a first ballast by a second ballast of different size but of the same nominal wattage presents the installer or the lighting fixture manufacturer with the problem of moving one of the two mounting brackets to a position inwardly or outwardly of its previous position in order to abut the ballast side plate and then remounting the bracket to the underlying mounting plate. Bracket relocating is especially troublesome for an installer who may be required to replace the ballast in situ in a lighting fixture which has not been provided with additional, properly located, tapped holes or apertures in the mounting plate. If the second ballast is of a different nominal wattage than the first ballast, then the transverse spacings between the bolt holes in the second ballast core will also be different and therefore, will not be in alignment with the bolt holes provided in the brackets for mounting the first ballast. In this case, two or more holes concentric with the bolt holes in the second ballast will now have to be drilled or punched through one leg of each bracket by the installer.

Moreover, since the bolts which pass through the cores and are captured by nuts at their ends may be of an appropriate length for the ballast core of smaller width; the mounting bolts could be too short to pass sufficiently far through a ballast core of greater width. On the other hand, the mounting bolts may prove to be too long. This is so because Underwriters Laboratory requires that the total length of the fully exposed threaded end projecting from the nut capturing the bolt or lug not exceed 3/16 of an inch. The purpose of this requirement is to ensure that the exposed threads do not extend far enough from the bracket to contact and abrade through the insulation of the luminaire's lead wires which may be near those threads. If the second ballast has a laminated core of smaller width than the first ballast but the same mounting bolts are used, to comply with these requirements it is necessary for the installer to provide suitable protective capping of the additional length of free thread ends now available through use of the thinner second ballast. Hence, to affect an approved replacement of the ballast may require that the installer and the fixture manufacturer maintain an inventory of mounting bolts of different lengths for possible use with ballasts of different widths or an inventory of a suitable type of protective thread cap.

The aforementioned problems resulting from the conventional use of brackets to mount lamp ballasts on luminaires is overcome by the instant invention.

SUMMARY OF THE INVENTION

This invention provides a new and improved device and method for attaching a luminaire ballast to a mounting or support plate. The device has an elongated shank at one end for insertion partway into one end of a hole provided in the ballast for a through bolt. The opposite end of the device is provided with an eyelet through which a threaded eyelet fastener may be inserted for attachment to the plate. The plate has an opening for accommodating the threaded fastener and the shank of the device has a length sufficient for it to remain inside the hole with the opening in the plate spaced far enough from an adjacent portion of a ballast so that ballasts of different width dimensions may be mounted to the plate by the device.

Preferably, pairs of devices are employed and mounted with their shanks substantially coaxial, each pair being inserted into a different end of the through hole in the ballast core and held on the plate by a headed machine screw, only the body of which passes through the device eyelet. The lengths of the shanks of the coaxial pairs are long enough to be insertable into ballasts to effect the desired attachment. The devices are inexpensive alternatives to conventional brackets and mounting bolts and make the task of replacing ballasts in luminaires considerably easier than is possible with conventional brackets and bolts because the shanks of the devices can simply be inserted into the ballast holes. Importantly, large inventories of different sized attachment devices are no longer required to be stocked by the fixture manufacturer or the installer.

The method of this invention contemplates providing a matrix of preformed mounting holes or apertures in the mounting plate which are spaced to accommodate ballasts of different wattages and of different sizes.

OBJECTS OF THE INVENTION

This invention has as its objective, a new and improved method and apparatus for mounting a lamp ballast on a luminaire.

Another object of this invention is to provide a plurality of inexpensive, standard-sized devices for attaching a wide range of different sized ballasts to a mounting plate.

Still another object of this invention is to provide apparatus for attaching light ballasts in a luminaire housing which compensates for ballasts of different wattages and different sizes.

BRIEF DESCRIPTION OF DRAWINGS

FIG. 1 is a plan view of one attachment device constructed in accordance with the principles of this invention.

FIG. 2 is a top plan view of a lamp ballast mounted on a luminaire support plate by the cooperative action of four of the devices shown in FIG. 1.

FIG. 3 is an end view of FIG. 2 with one portion of the ballast cut-away to fully illustrate the interengagement between a device and the lamp ballast.

DETAILED DESCRIPTION

Figure 4:
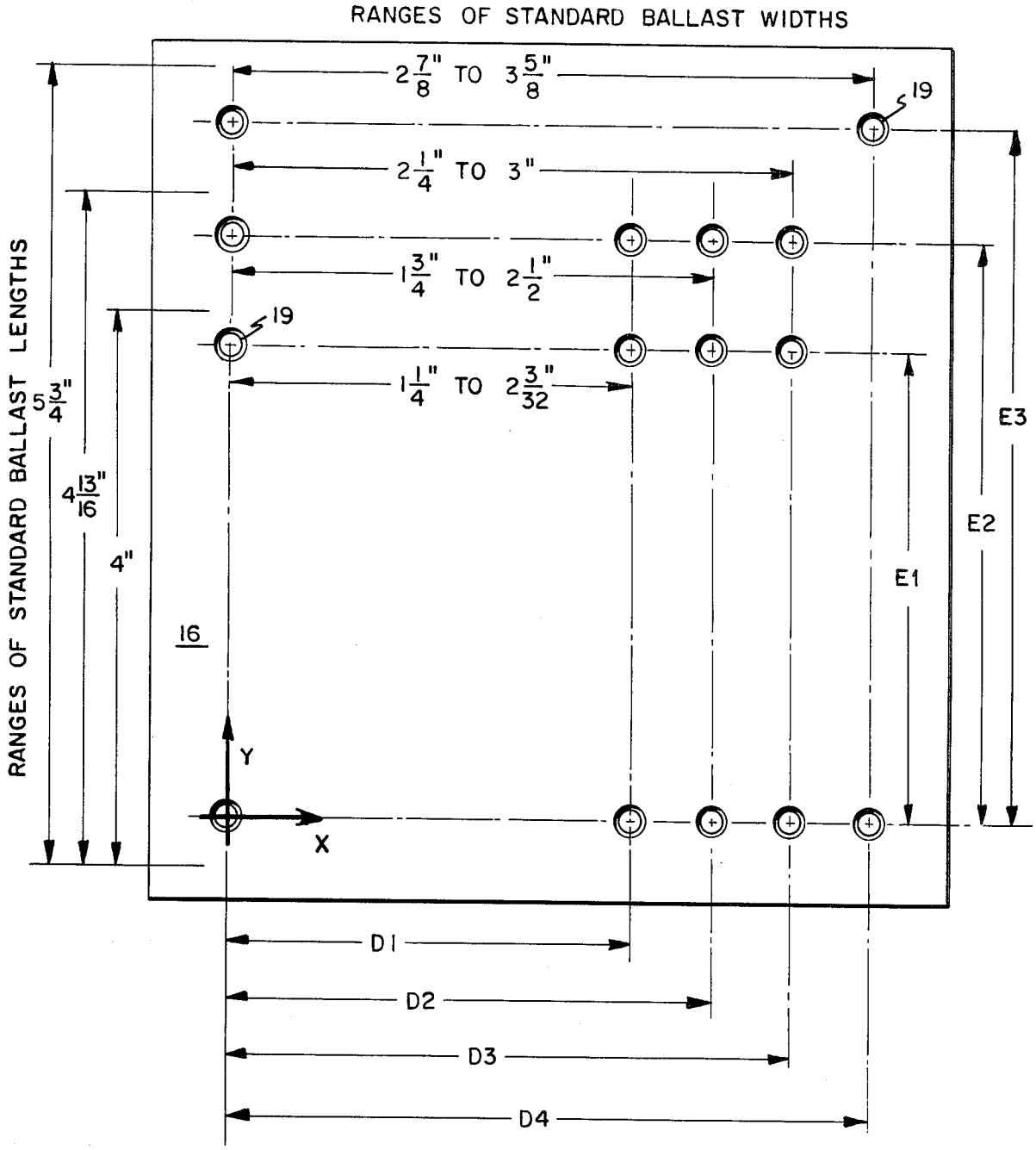
FIG. 4 is a top plan view of a ballast mounting plate illustrating the method of providing a matrix of mounting holes with predetermined spacings therebetween for accommodating several standard ranges of ballast sizes.

With reference to FIG. 1, an attachment device constructed in accordance with this invention and designated generally by the numeral 10, comprises a cylindrical shank portion 11 of circular, cross-section and a circular eyelet section 12 integral therewith which provides an end for attaching the device to the luminaire (not shown).

The device may be readily and inexpensively formed by cutting and bending a predetermined length of steel wire having a diameter of 0.187 inch to form the respective shank 11 and the eyelet 12 portions depicted in FIG. 1. The diameter of a mounting aperture or hole 13 is made slightly larger than the outer diameter of the threaded shank of a fastener which is utilized to attach the portions 12 of a plurality of devices 10 directly to a ballast support or mounting plate 16. Typically, the overall length of the device 10 is made approximately 1.635 inches, the section 11 length is about 1.00 inch and the internal diameter of the eyelet is about 0.25 inch. The device may be zinc plated in order to inhibit the formation of rust.

The fasteners which are used to mount the devices on the plate 16 are threaded screws or bolts 17 having head portions of greater diameter than the diameter of the aperture 13 so that the flat underside of the head portions of the screw or bolt 17 can be drawn tightly against the outer surfaces of an eyelet portion 12 when the bolt or screw head is tightened toward the support plate 16.

It will be understood that the ballast support plate 16 may be a wall of the luminaire housing or a separate plate member mounted to the interior of the housing. The mounting may be removable by providing conventional means for sliding or pivoting the plate from the housing. The support plates are often made to be removable to facilitate in situ replacement of a conventional ballast 18 and possibly the luminaire lamps (not shown) which may also be mounted on the plate. Moreover, the support plate may be extended in length substantially to mount other luminaire components, such as a capacitor, thereon.

Each screw or bolt 17 is accommodated in a mounting aperture or hole 19 drilled perpendicular into or through the plate 16. Opposite aperture pairs 19 spaced from the two outermost rectangular side plates **23*a*, 23*b* of a laminated, permeable core 23 of the ballast 18 are preferably provided. The core 23 embodies a primary coil winding 25 and a secondary coil winding 26. The shank 11 has good rigidity against bending about its longitudinal axis and its close proximity to the walls defining the bores 25 allows the shank to engage the walls defining the bores to prevent relative displacement in all planes between the ballast 23 and the support 16 once the fastening members 17** are firmly tightened down.

As mentioned hereinabove, conventional ballasts are usually manufactured with four elongated bores 28 located inwardly adjacent the four corners of the core 23. The longitudinal axes of the bores 28 are parallel and perpendicular to the plane of the plates forming the core 23. Typically, the bores 28 have diameters of 0.199 inch and are drilled completely through the laminated core by the transformer manufacturer to receive bolts or lugs which pass through two of the bores adjacent that side of the core which is to be mounted flush against underlying flat portions of the support plate 16 by the lighting fixture manufacturers.

As discussed hereinabove, conventionally, the ballast is mounted on the support plate by a pair of right angle brackets provided by the fixture manufacturer having one side thereof affixed to the surface of the support plate 16 by machine screws or bolts. The other side of each bracket is mounted flush against a respective one of the side plates **18*a* and 18*b*** and has four holes drilled therethrough in alignment with the opposite pairs of bore ends which are adjacent the surface of the support plate. The four holes in the brackets receive two bolts or threaded lugs having lengths slightly greater than the bores into which they are inserted so that nuts can be screwed onto the ends of the bolts or lugs which project from the bracket holes. The two bolts or lugs and the bracket thusly secure the ballast to the support plate. However, the practice of using brackets to attach the ballast to the support plate in accordance with the prior art has several disadvantages, as discussed hereinabove.

The present invention permits the on site replacement of one ballast having a width dimension W, FIG. 2, with another ballast of the same wattage rating but of slightly different width dimension W, without requiring the punching and tapping (if machine screws are to be used as the fastener means 17) of additional apertures substantially identical as the apertures 19 in the support plate 16, to account for the different spacings between the open bore ends and the apertures. This allows the lighting fixture manufacturer to punch-out (and tap) the apertures 19 at fixed locations relative to a reference point on an edge of the plate 16 before the fixture goes into the field. Templates may be used to facilitate the locations of the apertures 19. These locations are determined such that the centers of opposite pairs of apertures 19 would intersect the longitudinal axis of a bore with which the aperture pairs are associated.

The support plate 16 may also be fabricated by the luminaire manufacturer to mount various standard ballasts of different wattage ratings, for example, ballast ratings ranging from 50 watts to 400 watts. In such case, the aperture spacings are initially layed out as an orthogonal grid of intersecting lines parallel to the respective X and Y coordinate axes such as illustrated by FIG. 4. Once the points of intersection are determined, all the apertures are punched out simultaneously by a single operation of a punch press. Starting at the lowermost left end of the plate 16, as viewed in FIG. 4, the lower row line defines the X coordinate axis, on which at least one pair of opposing apertures is located. The leftmost column line, which passes through the centers of various apertures, defines the Y coordinate axis. This Y axis defines the location of the center of one aperture of the other pair required to attach the four opposite corners of the ballast. The X coordinate for the two lowermost lines is made equal to the transverse spacings between the bore holes in the particular ballast core and the intersection of these two lines with two column lines defines the centers of the opposite corner pair of apertures for that particular ballast. Other coordinate points for additional pairs of opposing mounting apertures for accommodating other sizes of ballasts can be located readily by extending the intersecting pairs of lines in directions parallel to the X and Y axes and providing other intersecting lines suitably spaced to account for the length of and the spacing between other core bores.

FIG. 4 depicts a matrix of apertures providing an exemplary mounting matrix for mounting standard ballasts ranging in nominal wattage value from, for example, 50 to 400 watts, inclusive. This range would include standard ballast wattages of 50, 70, 75, 100, 150, 175, 250 and 400 watts, respectively. Such ballasts have various width and length dimensions as indicated. The spacings between the parallel columns of apertures for each range of core width dimension is designated D1, D2, D3 and D4, respectively, whereas the spacings between spaced parallel rows of apertures for each range of standard ballast length dimension are designated E1, E2 and E3, respectively. Exemplary values for the dimensions D1, D2, D3 and D4 are 2.812 inches, 3.249 inches, 3.749 inches and 4.374 inches, respectively. Exemplary values for the dimensions E1, E2 and E3 are 3.500 inches, 4.375 inches and 5.375 inches, respectively. It will be understood that the ballast core which is located between two selected pairs of mounting apertures will usually extend in the Y coordinate direction a small distance beyond both aperture pairs; but this is of no consequence.

By practicing the instant method, a mounting plate is available to the ballast installer whereby a standard 50 watt ballast having a length of 4 inches and a width ranging from 1¼ to 2 and 3/32 inches can be mounted to the plate 16 through mounting apertures spaced 2.812 by 3.500 inches (dimensions D1 by E1), whereas a standard 400 watt ballast having a length of 5 and ¾ inches and a width ranging from 2 and ⅞ to 3 and ⅝ inches can be mounted to the plate through apertures spaced apart 4.374 by 5.375 inches (dimensions D4 by E3). As will be obvious, ballasts of other wattage ratings will be accommodated by other combinations of mounting apertures. Typically, opposing apertures 19 are located close enough to ensure that substantial portions, that is, more than one-half of the length of the device shanks 11, remain in each end of a bore for each different ballast size.

If desired, templates may also be made with an appropriate matrix of holes therein for facilitating the locating of punches or spindle drills required to generate a corresponding mounting hole pattern in the plate.

While one advantageous embodiment has been chosen to illustrate the invention, it will be understood by those skilled in the art that various changes and modifications can be made therein without departing from the scope of the invention as defined in the appended claims.

I claim as my invention:

1. In a luminaire, the combination of a ballast having a core formed of a plurality of flat plates laminated together with edges thereof substantially coextensive to provide one end portion having a width dimension in a plane at generally right angles to the plane of the plates, internal wall portions of the core defining at least one elongated bore of substantially circular cross-section extending through the core and the opposite outer plates thereof, the bore being oriented with the longitudinal axis thereof substantially perpendicular to the plane of said outer plates, and a ballast support plate having a plurality of spaced-apart support openings in the support plate, each of the support openings being spaced from a respective, outermost core plate and having a major axis substantially at right angles to the longitudinal axis of the bore, wherein the improvement comprises, a plurality of elongated mounting devices located on opposite respective sides of the outermost core plates, each of said devices having a smooth, elongated shank with a substantially uniform cross-sectional dimension slightly less than the corresponding cross-sectional dimension of the bore, the shanks of the devices being slidably and coaxially disposed in a different respective end of the bore to have a free end projecting outwardly from the bore, the free end of each of said devices being spaced from the supporting surface by a predetermined distance, at least a portion of which comprises free unobstructed space, individual fastener means engaged with the free ends of said mounting devices and inserted into different ones of the support openings to urge said free ends toward the support plate, said fastener means having a major axis thereof intersecting the longitudinal axis of the bore for mounting each of the free ends of said mounting devices, the distance between opposite, individual fastener means being greater than the width dimension of the largest ballast core to be mounted on the luminaire, the shank of each mounting device having a sufficient length for substantial portions of each shank to remain within a bore having a shorter length, corresponding to a ballast core having a smaller width dimension, than that of said largest core, the free end of each device having an aperture formed therein and being attached to said support by individual fastener means passing through each said aperture, whereby ballasts of different width dimensions are held on the luminaire by and between the devices.

2. Apparatus attaching a ballast element of a luminaire to a mounting plate on the luminaire comprising a ballast having at least two elongated bores therein, a plurality of ballast retaining pins of one-piece construction and substantially identical size and shape, each of said pins formed by an elongated straight shank portion of smaller diameter than the diameter of the bore for axial insertion therein and an eyelet portion integral with said shank portion of generally circular configuration extending outwardly from shank portion and having an open aperture receiving therein a fastener attached to said plate, the shank portions being slidably inserted axially into the bores and having a length sufficient for the shanks to remain within the bores while the circular portion is affixed to the mounting plate the circular portion of each of said pins being spaced from the mounting plate by an unobstructed space, and fastener means engaged with the circular portions and with mounting apertures in the mounting plate, urging said circular portions towards said plate to hold the ballast element attached to said plate.

3. The apparatus as claimed in claim 2 wherein the eyelet portion has curved portions which are substantially symmetrical with respect to an axis passing longitudinally through the shank portion.

4. The apparatus as claimed in claim 3 wherein the curved portions have a common planar surface which is spaced from, and substantially parallel to, an opposing planar surface of said mounting plate.

5. A method of mounting ballasts to a surface of a luminaire, the ballasts having substantially parallel mounting holes therein spaced a given distance apart comprising the steps of, sliding an elongated mounting pin part way into each of said holes, to leave a portion thereof projecting outwardly from the hole, arranging a free space between the projecting portion of each of said mounting pins and the supporting surface of the luminaire to permit said projecting portion to be urged toward said supporting surface, forming multiple holes in the supporting surface of the luminaire to receive ballast mounting devices, each hole located at an intersection defined by two pairs of orthogonal lines, the spacing between two parallel lines being substantially equal to said given distance and the spacing between the other two parallel lines being slightly greater than the length of the mounting holes, attaching a ballast fastener to the projecting portion of each such mounting pin to have one end thereof pass into one of said mounting holes, to urge the projecting portions toward said supporting surface and hold the ballast attached thereto, forming a plurality of additional holes in the surface of the luminaire with the centers of the additional holes substantially aligned with the centers of one pair of holes, the additional holes being spaced from one pair of holes to accommodate therebetween a ballast of different dimensions, and inserting one end of multiple ballast fasteners into different pairs of the holes corresponding to the size of the ballast.

6. The method according to claim 5 wherein all of the holes are formed in said surface at the time the luminaire is manufactured.

7. The apparatus of claim 2 further including a matrix of mounting apertures formed in the mounting plates defined by rows and columns of the apertures, the dimensions between the respective rows and columns being such that ballasts of different sizes may be selectively mounted on the mounting plate.

8. The apparatus of claim 2 wherein the bores extend through the ballast element, and two of the pins extend into each of the bores from the opposite ends thereof, to have the eyelets of such pins extending outwardly from the opposite ends of the bore.

9. A support arrangement attaching an electrical ballast unit to a supporting surface which extends along one surface of said ballast unit, comprising an electrical ballast unit, means forming elongated apertures extending into said ballast unit from at least two opposite surfaces thereof, said opposite surfaces being transverse to said one surface, at least two elongated supporting members, each of which is located within, and slidable within, one of said elongated apertures, with a portion thereof projecting outwardly from the aperture, the projecting portion of each of said elongated supporting members being spaced from the supporting surface by an unobstructed space, and means engaged with the projecting portions of said elongated supporting members, and with the supporting surface, urging said projecting portions towards said supporting surface to hold the ballast unit attached to said supporting surface.

10. A support arrangement as in claim 9 wherein the projecting portions of the elongated supporting members lie in a plane which is generally parallel to supporting surface until they are urged toward said supporting surface by said last mentioned means.

11. A support arrangement as in claim 9 wherein the last mentioned means includes a clamping member in engagement with each of said projecting portions, each such clamping means being disposed in line with the axis of one of said elongated apertures.

12. A support arrangement as in claim 9 wherein said elongated apertures and said elongated support members are both cylindrically shaped and have substantially the same cross-sectional configuration.

13. A support arrangement as in claim 12 wherein each of said elongated supporting members includes an eyelet in its projecting portion, and wherein said last mentioned means includes a screw-threaded member passing through said eyelet and into said supporting surface.

14. A support arrangement attaching an electrical ballast unit to a supporting surface, comprising an electrical ballast unit, means forming elongated apertures extending into said ballast unit from at least two opposite surfaces thereof, said opposite surfaces being transverse to said supporting surface, at least two elongated cylindrically-shaped supporting members, each of which is located within, and slidably movable within, one of said elongated apertures, and has a free end projecting outwardly from the aperture, the free end of each of said elongated supporting members being spaced from the supporting surface by a predetermined distance, at least a portion of which comprises free unobstructed space, and means engaged with the free ends of said elongated supporting members, and with the supporting surface, urging said free ends towards said supporting surface to hold the ballast unit attached to said surface.

15. A support arrangement as in claim 14 wherein said elongated apertures and said elongated support members are cylindrically shaped, and have substantially the same cross-sectional configuration and dimensions.

16. A support arrangement as in claim 14 wherein the free end of each of said elongated supporting members includes an eyelet portion, and wherein said last mentioned means includes a screw-threaded member passing through said eyelet and into said supporting surface.

17. A method for attaching an electrical ballast unit to a supporting surface which extends along one surface of said unit comprising forming elongated apertures extending into said ballast unit from at least two opposite surfaces thereof which are transverse to said one surface, sliding an elongated supporting member part way into each one of said elongated apertures, so as to have a free end projecting outwardly from the aperture, the free end of each of said elongated supporting members being disposed away from the supporting surface by an unobstructed space, and urging said free ends towards said supporting surface to hold the ballast unit attached to said supporting surface.

18. A method as in claim 17 wherein the step of urging comprises passing a screw-threaded member through the free end of each of said elongated supporting members and into said supporting surface.

19. A method for attaching an electrical ballast unit to a supporting surface which extends along one surface of said unit, said unit having elongated apertures extending into it from at least two of its opposite surfaces, comprising sliding an elongated supporting member part way into each one of said elongated apertures, to leave a portion thereof projecting outwardly from the aperture, arranging a free space between the projecting portion of each of said elongated supporting members and the supporting surface to permit said projecting portion to be urged toward said supporting surface, and urging said projecting portions towards said supporting surface to hold the ballast unit attached to said supporting surface.

20. A method as in claim 19 wherein the sliding step comprises sliding the elongated supporting members into the respective elongated apertures along a plane which is spaced from said supporting surface.

21. A method as in claim 19 wherein the urging step comprises clamping the projecting portions of the elongated supporting members with the supporting surface, each at a point which is disposed in line with the axis of one of said elongated apertures.

* * * * *